US005758591A

United States Patent [19]

Papajewski et al.

[11] Patent Number: 5,758,591

[45] Date of Patent: Jun. 2, 1998

[54] MAIN CAM FOR A BUTTONHOLE SEWING MACHINE

[75] Inventors: Rudy Papajewski; Gerd Papajewski, both of Stutuensee, Germany

[73] Assignee: AMF Reece, Inc., Mechanicsville, Va.

[21] Appl. No.: 779,127

[22] Filed: Jan. 6, 1997

[51] Int. Cl.[6] ..... D05B 3/06

[52] U.S. Cl. ..... 112/475.25; 112/65; 112/448

[58] Field of Search ..... 112/65, 67, 70, 112/157, 475.25, 443, 446, 448, 459

[56] References Cited

U.S. PATENT DOCUMENTS

| | | | |
|---|---|---|---|
| 3,401,659 | 9/1968 | Kasuga | 112/448 |
| 3,426,709 | 2/1969 | Jindrich et al. | 112/448 X |
| 3,635,179 | 1/1972 | Ueltschi | 112/448 |
| 3,841,246 | 10/1974 | Casner et al. | 112/448 X |

*Primary Examiner*—Paul C. Lewis
*Attorney, Agent, or Firm*—James Creighton Wray; Meera P. Narasimhan

[57] ABSTRACT

A main cam of a buttonhole sewing machine has four cams connected together in an assembly which includes a drive disk switch spring. A worm hub and a drive disk are connected together. A shifter mechanism has right and left shifter arms and springs which periodically capture and release the drive disk switch spring. The drive disk and worm hub are driven by a worm gear on the main drive shaft. One of the shifter arms holds the switch spring in a detent, disengaging the switch spring from the drive disk while the buttonhole sewing machine sews bight stitches along a first side of the buttonhole site in a workpiece. The workpiece is clamped between a clamping plate and a clamp. The clamping plate moves in steps while the needle is up. When the clamping plate reaches the end of the intended buttonhole a shift plate is moved, moving the shift arms, releasing the switch spring from the first switch arm and positioning the second switch arm for capturing the switch spring. The switch spring engages the drive disk and drives the cam until the switch spring is captured in the second arm. While the switch spring is moving the multiple cams, the feed cam disengages the feed and a barring cam and follower move the clamp plate laterally to form large barring stitches at the end of the buttonhole site.

14 Claims, 7 Drawing Sheets

MAIN CAM FOR A BUTTONHOLE SEWING MACHINE

BACKGROUND OF THE INVENTION

Buttonhole sewing machines have complex high speed motions. The sewing machines clamp a workpiece and start sewing. Usually a machine sews bight stitches while a feeder feeds a clamp and plate along one side of the buttonhole, and then stops for forming large barring stitches at one end of the buttonhole. The feeder restarts for sewing bight stitches along the second side of the buttonhole, and then stops for forming large bar stitches at the second end of the buttonhole. Finally the buttonhole is cut, the clamp is released and the thread is trimmed.

The control and interrelationship of the various motions requires great accuracy. Needs exist for integrated controls capable of high speed operation with dependability and long life.

SUMMARY OF THE INVENTION

The present invention provides a new buttonhole sewing machine main cam to provide long life and dependable accuracy at high speeds.

A main cam of a buttonhole sewing machine has four cams connected together in an assembly which includes a drive disk switch spring. A worm hub and a drive disk are connected together. A shifter mechanism has right and left shifter arms and springs which periodically capture and release the drive disk switch spring. The drive disk and worm hub are driven by a worm gear on the main drive shaft. One of the shifter arms holds the switch spring in a detent, disengaging the switch spring from the drive disk while the buttonhole sewing machine sews bight stitches along a first side of the buttonhole site in a workpiece.

The workpiece is clamped between a clamping plate and a clamp. The clamping plate moves in steps while the needle is up. When the clamping plate reaches the end of the intended buttonhole a shift plate is moved, moving the shift arms, releasing the switch spring from the first switch arm and positioning the second switch arm for capturing the switch spring.

The switch spring engages the drive disk and drives the cam until the switch spring is captured in the second arm. While the switch spring is moving the multiple cams, the feed cam disengages the feed and a barring cam and follower move the clamp plate laterally to form large barring stitches at the end of the buttonhole site. A barring tension/knife cam and follower relieve tension on the thread while the long barring stitches are being formed. As the switch spring is being captured by the second shifter arm, the feed cam reverses the feed to the opposite direction, and the cam is stopped while the bight stitches are formed on the second side of the buttonhole site.

When the clamp plate reaches its original starting point, the feed plate is shifted, releasing the switch spring for engagement with the drive disk. The feed disk on the cam stops the feed. The barring disk drives the barring follower to move the clamp plate from side to side while the tension/knife disk reduces tension on the thread. Just before the switch spring engages the first shifter arm, the stop disk trips a toggle for disengaging a clutch and activating a stop lever, and the tension/knife disk activates a knife to cut the buttonhole.

A preferred buttonhole sewing machine main cam apparatus has an assembly with a barring cam, a barring tension/knife cam disk, a feed reversing cam disk, a stop cam disk and a drive switch spring connected together for rotating as a unit. A drive disk and worm gear hub are continuously driven by a worm gear on a main drive shaft of the buttonhole sewing machine.

The barring cam, the barring tension/knife cam disk, the feed cam disk and the stop cam disk are connected with screws and nuts. The drive disk switch spring is connected at one end to the cam disks and is urged away from the cam disks by springs at another end.

The barring cam, the barring tension/knife cam disk, the feed cam disk and the stop cam disk have central openings extending through the disks. A shoulder screw extends through the central openings for mounting the elements on a buttonhole sewing machine body.

The barring cam has a central bushing extending axially from the barring cam. The tension/knife cam disk, the feed cam disk, the stop cam disk and the drive disk switch spring have large central openings which are received on the bushing.

A main cam brace is rotatably connected to the drive disk and worm gear hub by the shoulder screw.

First and second hub shoulder screws are connected to the cam brace. A feed reversing lever is connected to the first shoulder screw for contacting the feed reversing cam disk. A knife actuating lever is connected to the first hub shoulder screw for contacting the tension/knife cam disk.

A barring lever has a bushing connected to the second hub shoulder screw. The barring lever has an extension on which a stud is mounted, and a first, inner cam follower roller is mounted on the stud. A cap screw is connected to the extension and an eccentric is connected to the cap screw. An outer roller is connected to the eccentric. The inner and outer rollers respectively move along inner and outer cam surfaces of the barring cam.

A shifter mechanism is slidable with respect to the cam. The shifter mechanism has a main cam shifter plate. A right shifter block is connected to the shifter plate. A right shifter arm is connected to the right shifter block. A right shifter spring is connected to the right shifter arm for positioning on one side of the cam, and a left shifter block is connected to the plate. A left shifter arm is connected to the left block, and a left shifter spring is connected to the left shifter arm for positioning on an opposite side of the cam. The shifter plate is movable to engage the right shifter arm or the left shifter arm with the drive disk spring.

The shifter plate has an extension with an elongated opening. An adjustable link nut is mounted in the elongated opening. A buttonhole adjusting link connects to the adjustable link nut. A screw is connected to the adjustable link nut and the buttonhole adjusting link for securing the link nut and adjusting link along the elongated opening for determining buttonhole length.

A preferred method of coordinating movements in a buttonhole sewing machine includes stopping a main cam assembly during forming of bight stitches on sides of a buttonhole. The main cam is driven during formation of long barring stitches at ends of buttonholes. A barring lever is driven back and forth with a barring cam on the cam assembly. Thread tension is released with a tension/knife cam disk and follower during forming of the barring stitches. A feed reversing lever is held in neutral with a feed reversing cam during cam movement, and the feed reversing cam moves at the end of the cam movement.

A shifting plate is shifted upon a completion of feed along a side of a buttonhole, and the drive disk switch spring is captured with a shifter arm.

Parallel arms on opposite sides of the main cam are shifted. The drive disk switch spring is released with the shifting, while the opposite arm is positioned for capturing the drive disk switch spring. As the cam rotates the drive disk switch spring to the second arm, the drive disk switch spring is captured in the second arm. The switch spring is held in the second arm while the sewing machine forms stitches along the side of a buttonhole. The plate is shifted and the drive disk switch spring is released from the second arm, while the first arm is positioned for capturing the drive disk switch spring.

A preferred method of operating a buttonhole sewing machine includes rotating a drive shaft and a worm gear mounted on the drive shaft. A worm gear hub and a drive disk are rotated with the worm gear. A main multiple disk cam switch spring is held with a first shift arm while forming bight stitches along one side of the buttonhole. The first switch arm is moved away from the multiple disk cam, and a second switch arm is moved close to the multiple disk cam. The switch spring is released from the first arm and the switch spring is engaged with the drive disk. Thread tension is reduced with a cam disk and follower. A clamp plate slidestone is moved back and forth with a barring cam in the cam assembly and a barring lever cam follower. The drive disk switch spring is captured with the second shift arm and thread tension is restored with a cam follower moving into a depression in the tension cam disk. Feed direction is shifted with a cam disk and feed reversing lever follower. The main cam is stopped by disengaging the switch spring from the drive disk with the second lever arm. Bight stitches are stitched along the second side of the buttonhole while the cam disk assembly is stopped. The first and second shift arms are shifted by moving the second shift arm away from the cam disk assembly and moving the first shift arm near the cam disk assembly. The drive disk switch spring is released with the second switch arm. The drive disk switch spring is engaged with the drive disk for driving the cam assembly. A clamp plate slidestone is moved back and forth with the barring cam and barring cam follower. Thread tension is reduced with a tension cam. A knife operation is controlled with a knife cam disk. A toggle is tripped with a stop cam for stopping the drive shaft.

The cam is driven upon engaging the drive shaft into a detent on the first shifter arm and engaging a feed by moving a feed reversing arm from a neutral position to a first directional position.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
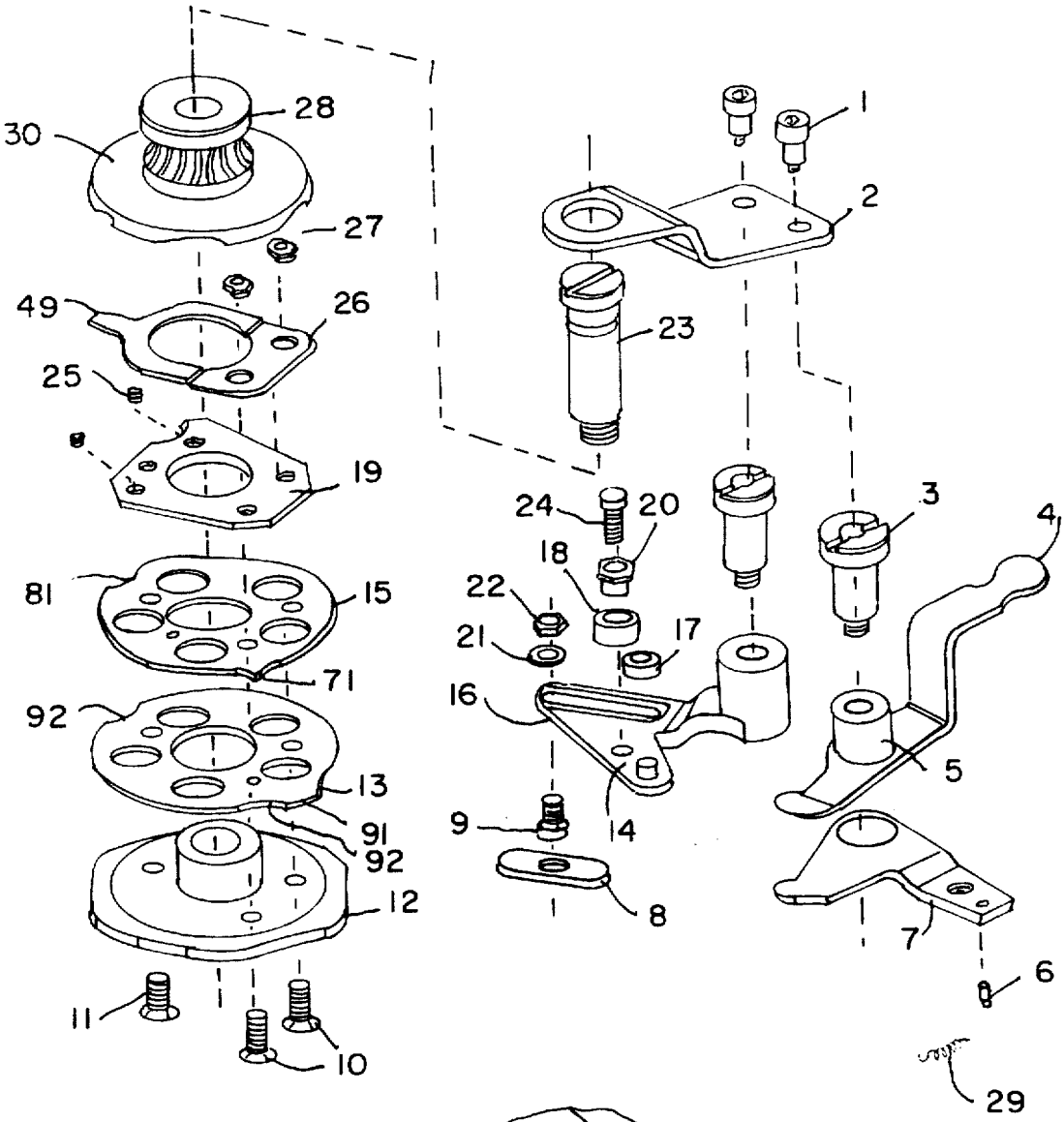
FIG. 1 shows an inverted exploded view of a main cam, cam drive and follower assemblies for a buttonhole sewing machine.
Figure 2:
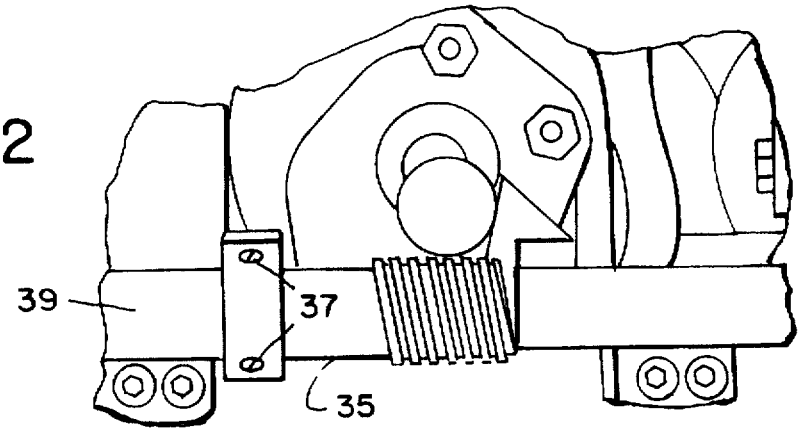
FIG. 2 shows a bottom view of a worm gear held in position on the main drive shaft by set screws and showing a drive spring in a partial cam assembly.

Referring to FIG. 1, the main cam is made up of four cams, a barring cam 12, a barring tension/knife cam 13, a feed reversing cam disk 15 and a stop cam disk 19. An additional member is a drive disk switch spring 26, which is secured to all of the cams. The switch spring is driven by a drive disk 30, which is fixed to a worm gear hub 28. The worm gear hub 28 is driven by a worm gear attached to the main drive shaft, as shown in FIG. 2. A main cam brace 2 has an opening which aligns with the central openings in the cams and worm gear hub to receive a shoulder screw 23. The main cam brace 2 is mounted with shoulder screw 23 and shoulder screws 1, which are in turn connected to cam follower hub shoulder screws 3. A feed reversing lever 4 with a hub 5 is connected to the right hub shoulder screw 3. A knife actuating lever 7 is mounted beneath the feed reversing lever 4 and hub 5 on the right hub shoulder screw 3. A spring anchor pin 6 is mounted in one end of the knife actuating lever 7, and a tension spring 29 is connected to the spring anchor pin 6 and to a fixed position on the machine for holding the knife actuating lever 7 against the barring tension/knife cam 13.

A clamp plate slidestone 8 is connected with a slidestone retaining screw 9 to an elongated groove in the barring lever 16 using washer 21 and nut 22. Barring lever stud 14 mounted on the barring lever 16 holds a barring lever roller 17, which follows the inner cam surface on barring cam 12. A cap screw 24 extends through barring lever eccentric 20, which supports barring lever roller 18. The screw 24 is connected to an opening in the barring lever 16 near the barring lever stud 14. Roller 18 follows the outer cam surface of barring cam 12. The barring lever 16 has a hub which is fixed to the barring lever and which rotates on the left hub shoulder screw 3.

The cams 12, 13, 15 and 19 and drive spring 26 are held together by screws 10 and shoulder nuts 27. Cams 12, 13, 15 and 19 are also held together by screw 11. Springs 25 mounted within guide openings in the stop cam disk 19, and which extend through enlarged aligned openings in disks 15 and 13 and bear against a flat surface of cam 12 to push the drive disk switch spring into engagement with one of the notches in drive disk 30.

The drive spring 26 and cam disks 19, 15 and 13 have central openings which are mounted on the hub 31 fixed on cam 12. In FIG. 2 the drive disk, worm hub and brace are removed to show the multiple cam and drive spring assembly.

FIG. 2 shows the worm gear 35 held in position on main drive shaft 39 by set screws 37.

Figure 3:
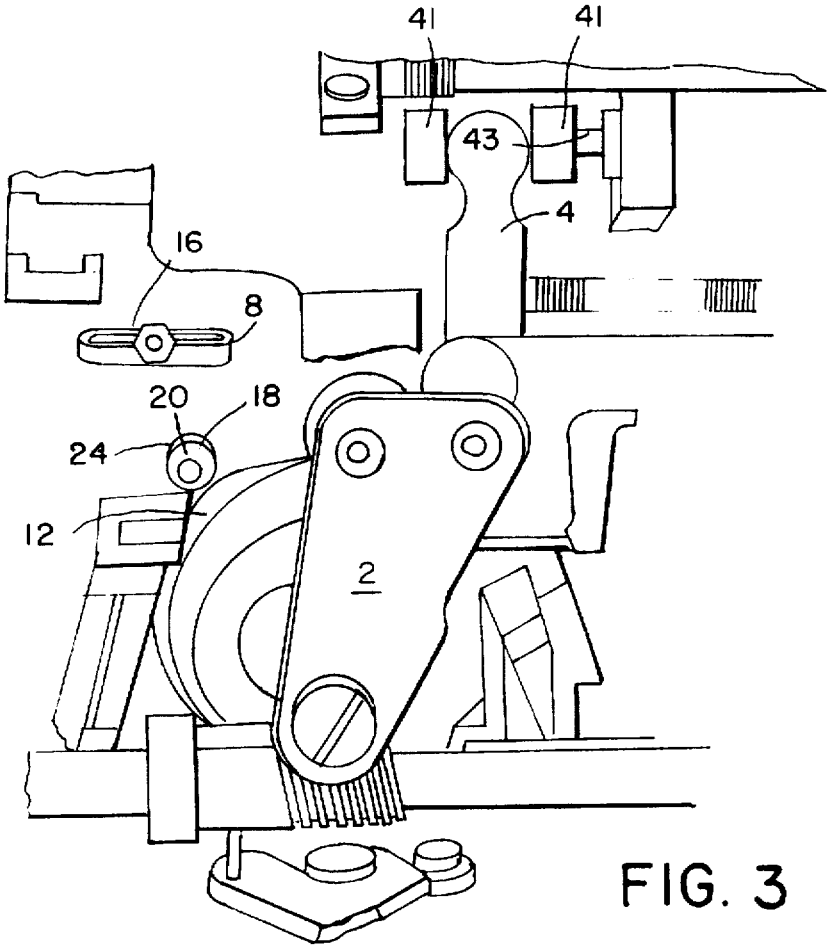
FIG. 3 is a bottom view of the main cam and follower assemblies and worm drive, showing the barring eccentric follower mounted on the cap screw, with the eccentric-mounted roller contacting a lobe on an outer surface of the barring cam.

FIG. 3 shows the barring eccentric lever 20 mounted on cap screw 24, with the roller 18 contacting a lobe on the outer cam surface of the barring cam 12.

As the rollers follow the barring cam, the barring lever 16 moves the clamp plate slidestone 8 to move the clamp plate, clamp and workpiece, for forming the long barring stitches.

FIG. 3 also shows the feed reversing lever 4 between two followers 41 for shifting the feed drive shaft 43 between neutral and opposite feed directions. The feed reversing lever 4 follows the feed reversing cam 15, as shown in FIG. 1.

Figure 4:
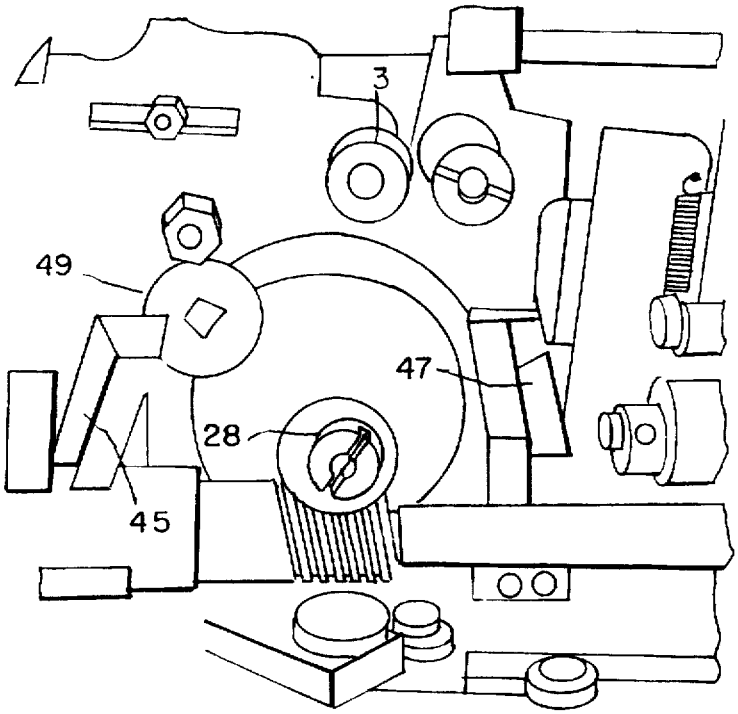
FIG. 4 is a bottom view of the clutch and drive assemblies from which the main cam brace has been removed for showing the shifter arms.

FIG. 4 shows the shifter arms 45 and 47. The brace has been removed for clarity. As shown in FIG. 4, when the shifter arms are slid to the left, the left shifter arm releases the nose 49 on the drive spring 26. That releases the drive spring from the shifter arm detent; the drive spring engages a notch in the drive disk 30, and worm gear drive hub 28 rotates the multiple cams. The barring cam causes the barring follower, the slidestone and the clamp plate, clamp and workpiece to make three side-to-side motions, making three barring stitches to form the first bar at one end of the buttonhole.

As the drive spring comes into contact with the right shifter block, the drive spring nose is pressed down out of engagement and into a detent in the right shifter block. That stops the first bar. At the same time the feed reversing cam 15 moves the feed reversing lever 4 to move the followers 41 and the feed shaft 43, for engaging another feed gear and reversing the feed direction for step-by-step movement of the clamp plate, workpiece and clamp, forming the second row of lateral bight stitches along the buttonhole site. After a number of revolutions of the drive shaft, a second row of lateral bight stitches is formed along a second side of the buttonhole site.

Figure 5:
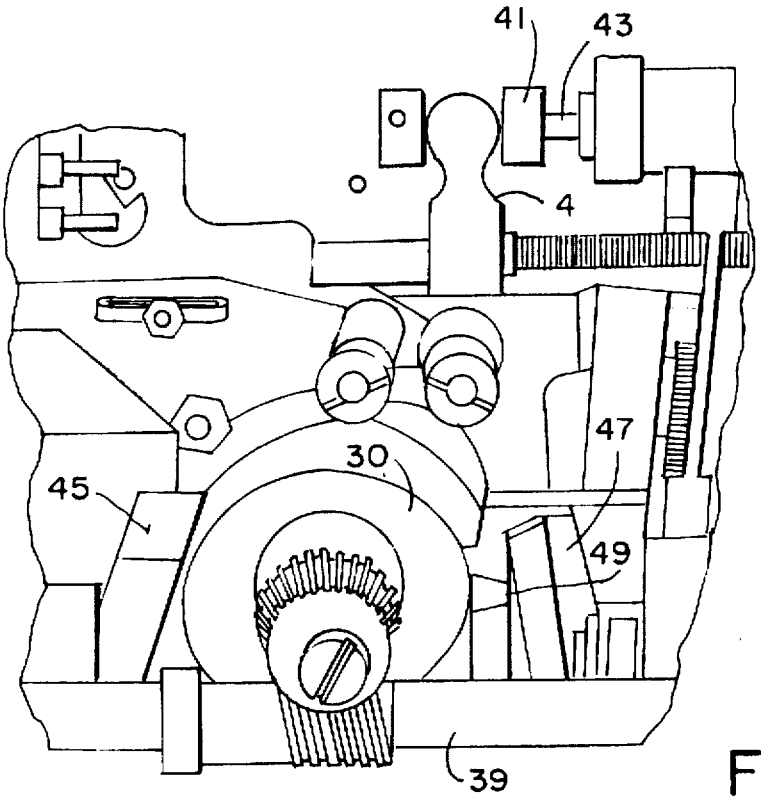
FIG. 5 shows the drive spring nose after release from the right shifter block.

As the clamp plate feed reaches its end, the shifter arms are moved to the right, as shown in FIG. 5, releasing the drive spring 26 from the right shifter arm detent and permitting the engaging of the drive spring with a notch in the drive disk 30 on the drive hub. Continued turning of the drive shaft causes the feed reversing cam disk 15 to centralize the feed reversing lever 4, disengaging the feed. The tension/knife cam disk prevents its intermediate level, reducing thread tension. The barring follower lever 16 is moved back and forth by the barring cam 12 and the rollers 17 and 18, making the second group of three barring stitches at the second end of the buttonhole. At the last stitch the stop cam disk 19 toggles off the knock off assembly, which causes a spring to move a slide bar away from a clutch-engaging and stop lever holdout position, setting the machine for stopping.

Figure 6:
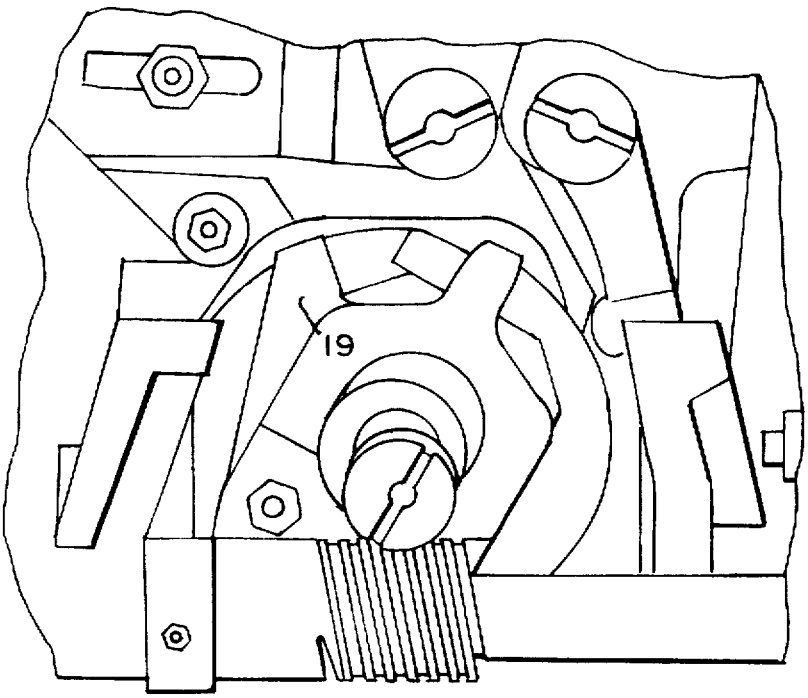
FIG. 6 shows the stop cam disk and drive spring on the cam assembly, from which the drive disk, worm hub and brace have been removed.

FIG. 6 shows the stop cam disk 19 which, at the end of the second bar, strikes a vertical pin on a toggle assembly, causing it to turn. That releases the stop/start slide bar and prepares the machine for stopping.

Figure 7:
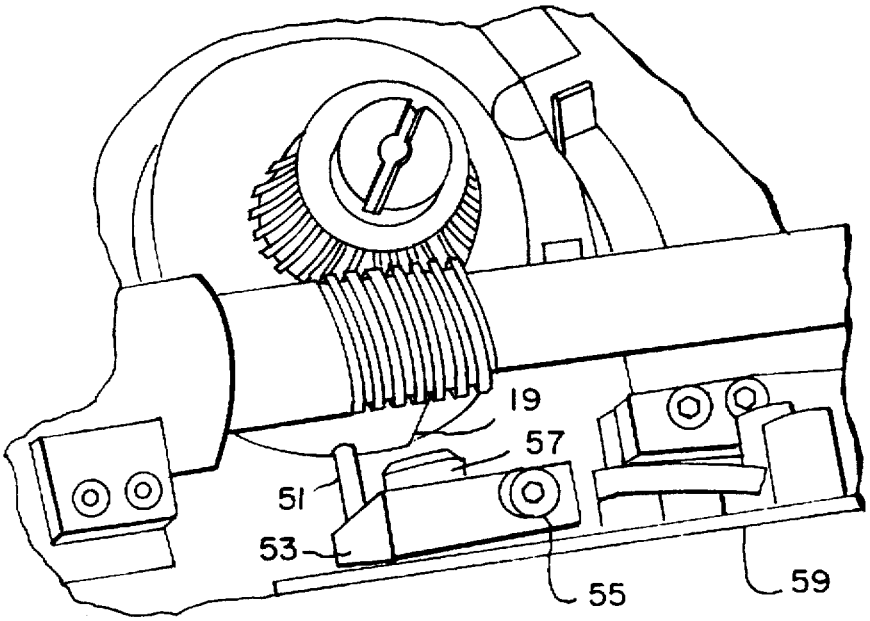
FIG. 7 shows the stop cam disk approaching a pin on the knock off arm of the start/stop slide bar.

FIG. 7 shows the stop cam disk 19 approaching the pin 51 on the toggle assembly 53, which is clamped with a clamping screw 55 on the knock off arm 57 of the start/stop slide bar 59.

Figure 8:
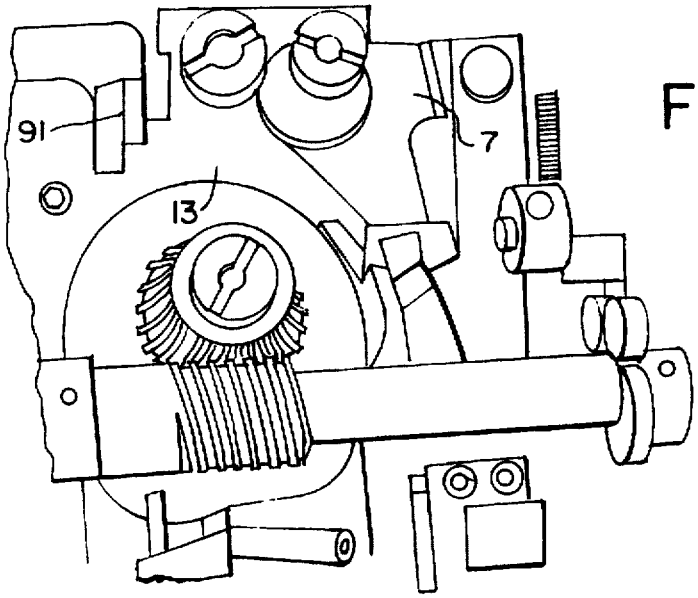
FIG. 8 shows the highest point on a barring tension/knife cam disk moving the knife actuating lever.
Figure 9:
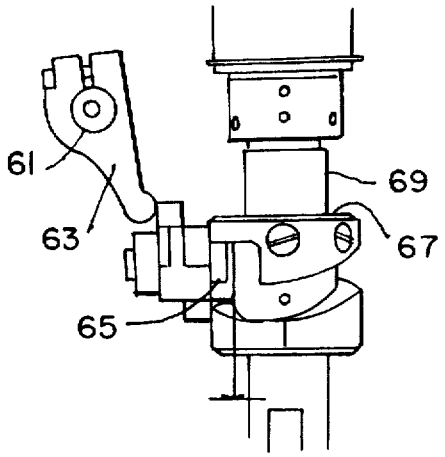
FIG. 9 shows an engaging cam connected to the knife actuating lever for inserting a follower pin in a knife drive cam mounted on the needle bar shaft.

Next, as shown in FIG. 8, the highest point 91 on the tension/knife cam disk 13 moves the knife actuating lever 7. The movement of the knife actuating lever 7 acts through shaft 61, as shown in FIG. 9, causing the engaging cam 63 to move the knife follower pin 65 into engagement with the knife cam 67 on the upper, needle bar drive shaft 69. In one final turn of the upper, needle bar drive shaft 69, after power has been removed, cam 67 drives the knife downward between the side bight stitches and the end bar stitches, cutting the buttonhole, and then pulls the knife upward while the machine is stopping, absorbing some kinetic energy of the machine.

In the last movement of the drive shaft, a stop cam pushes a stop lever outward, compressing a spring and releasing a toggle on the clamp, releasing the workpiece for movement to a new buttonhole location. The stop lever is pulled inward into contact with a flat of a stop cam, stopping the drive shaft.

Figure 10:
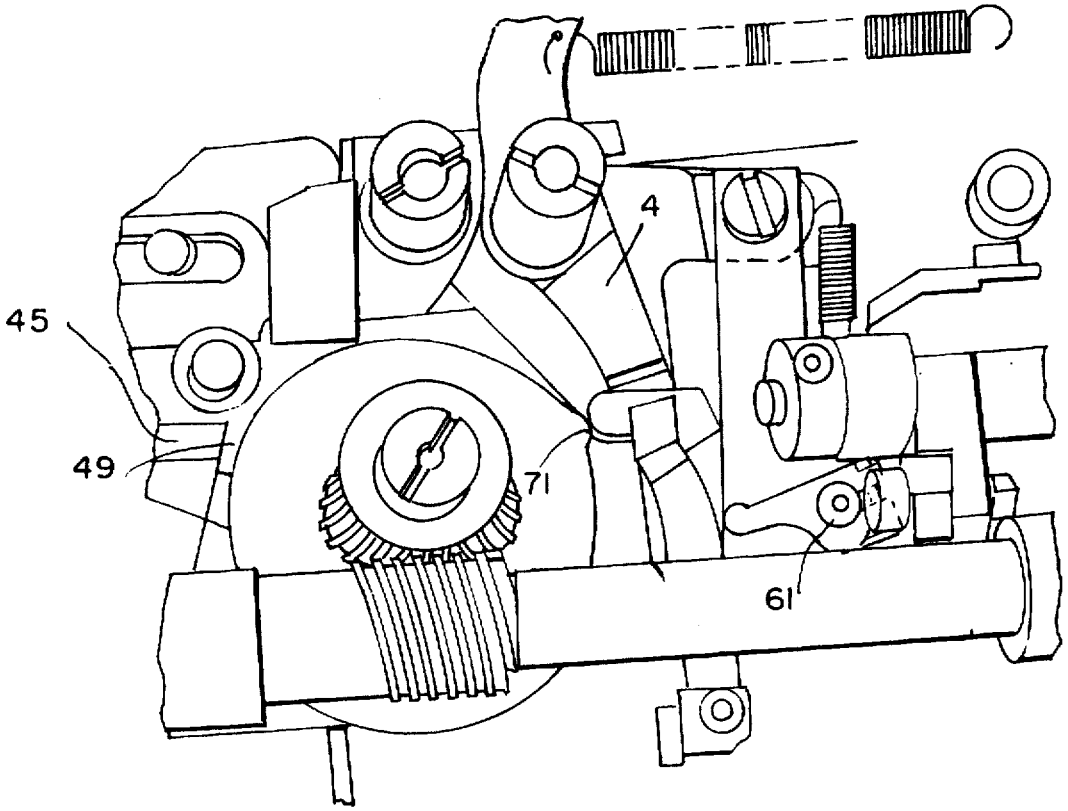
FIG. 10 shows a lobe on the feed reversing cam contacting the feed reversing lever for moving a feed shaft to the left for engaging a right feed gear.

As shown in FIG. 10, the lobe 71 of the feed reversing cam 15 contacts the feed reversing lever 4 and moves the feed shaft to the left for engaging the right feed gear. The shifter arm 45 then engages the nose 49 of the drive spring 26 and holds the drive spring in a detent away from the main cam drive lobe 30, making the machine ready for the first row of bight stitches in a first direction along the side of the buttonhole.

Figure 11:
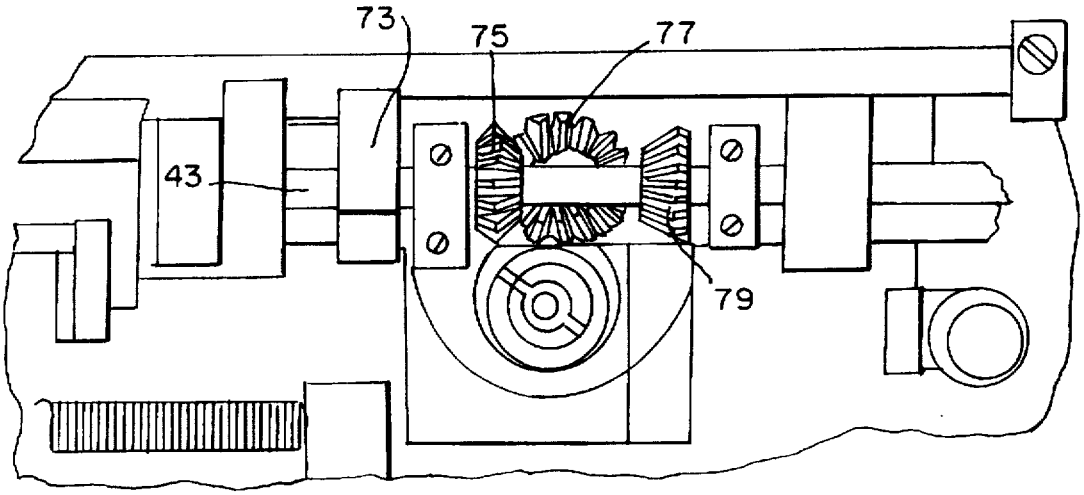
FIG. 11 shows the intermittent drive shaft, which is moved by a drive crank with a ratchet connection.

FIG. 11 shows the intermittent drive feed shaft 43, which is moved by a ratchet connection with drive crank 73. As shown, the shaft 43 is moved to the right, and the left bevel drive gear 75 is engaged with the vertical gear 77 to drive the feed in a second, opposite direction. When the shaft 43 is moved to the left, the right gear 79 is engaged with the vertical gear, driving the clamp and clamp plate and workpiece in the first direction, while bight stitches are formed along a first side of the buttonhole.

The position shown in FIG. 11 with the left gear 75 driving the vertical gear 77 is achieved when the follower end 83 moves into the depression 81 of the feed reversing cam 15, as shown in FIG. 1.

The machine comes to a stop in a home position with a stop lever resting on a flat side of the stop cam. The nose 49 of the drive spring 26 is within two millimeters of dropping into the detent on the left shifter arm. Two horizontal bevel gears are centered and disengaged from the vertical bevel gear, and the clamp plate is to the right, toward the head of the casing.

To start sewing, a small foot pedal is pressed all of the way down and released. The machine will automatically clamp the material, sew and cut the buttonhole, trim the thread and stop with the clamp in a raised position, ready for starting the next buttonhole. Pressing down on the small foot pedal causes an air cylinder to slide a start/stop bar to the right. Movement of the stop bar straightens a toggle to hold the start/stop bar to the right. The start/stop bar moves the stop lever to the right, out of engagement with the stop cam. At the same time, the start/stop slide bar presses a clutch spring to engage the clutch and start the main drive shaft 39.

Rotation of the drive shaft 39 rotates the worm gear 35 and the cam hub 28, turning the cam assembly until the nose 49 of the drive spring 26 is fully into the detent on the left shifter arm 45. The cam assembly stops with the feed reversing cam 15 in a position where the cam follower 83 of the feed reversing lever 4 moves into the depression 81, sliding the feed shaft 43 to the right and engaging the left gear 75 with the vertical gear 77. That intermittently drives the clamp plate, clamp and workpiece forward while the needle is up, producing a first line of bight stitches along a first side of the buttonhole. As the clamp plate reaches an end of the buttonhole, the shifter arms are shifted to the left. That releases the drive spring from the detent in the last shifter arm. The drive spring 26 engages a notch of the drive disk 30 and causes the cam to turn with the drive hub 28. The cam follower of the feed reversing lever rides along an intermediate cylindrical portion of the feed cam, which centers the feed shaft 43 and disengages both gears 75 and 79 from the vertical gear 77. The turning of the barring cam 12 moves the barring lever to move the clamp plate, clamp and workpiece from side to side, forming three barring stitches at an end of the buttonhole.

As the drive spring continues to rotate, it comes into contact with the right shifter block arm. The drive spring nose is pressed down out of engagement with the drive hub and into a detent into the right shifter arm. That stops the first bar stitches. As the drive spring is moving into the detent, the feed reversing cam causes the lobe 71 to move the follower 83 to the right and shift the feed reversing lever 4 and the feed shaft 43 to the left, engaging right gear 79 with the vertical gear 77. While the drive spring is held in the detent disengaged from the drive hub, the feed shaft 43, right gear 79 and vertical gear 77 intermittently feed the clamp plate, clamp and workpiece in the reverse direction. Several revolutions of the drive shaft form the second row of bight stitches at the second side of the buttonhole.

As the clamp plate nears the first end, the shifter arms are slid to the right, releasing the drive spring 26 from the detent in the right shifter arm. The drive spring 26 engages the drive disk 30, and the drive hub 28 turns the feed cam with the worm gear 35. The feed reversing lever follower 83 moves along an intermediate arcuate portion of the feed reversing cam 15, centering the feed shaft, so that neither bevel gear 75 nor 79 engages the vertical feed gear 77. Continued turning of the drive shaft causes the barring cam 12 and barring lever 16 to move the clamping plate, workpiece and clamp sideways back and forth to make the second group of three large barring stitches. Movement of the main cam at the start of the last barring stitch contacts the knock off arm on the start/stop toggle with the stopping cam 19, releasing the clutch and setting the machine for stopping. The knife cam 13 causes the knife follower 7 through intermediate members to move the knife drive pin into engagement with the knife drive cam on the upper, needle bar drive shaft, for cycling the knife into and out of the fabric and cutting the buttonhole between the side bight stitches and the end barring stitches.

After the clutch has been released, a low point on the stop cam aligns with the stop lever. The stop lever moves onto the stop cam. In a last partial rotation, the stop cam lifts the stop lever against spring force, which slows the drive shaft. The spring force raises a pawl, releasing the clamp and allowing movement of the workpiece to a new buttonhole location. In the final quarter revolution, the spring force urges the stop lever against the flat of the stop cam, bringing the machine to a complete stop.

The clamp automatically clamps when the pedal is depressed, pulling down on a clamp toggle lever. The clamp toggle lever is connected to a clamp shaft which traverses the machine. A clamp actuator arm and a pawl holder arm are secured to the clamp shaft. The pawl holder arm has a pawl retainer. A pawl at its free end contacts a flange on a cylinder surrounding a stop bolt spring. As the stop bolt spring is compressed by pulling on the stop bolt with the stop lever, the cylinder moves. A cylinder flange moves and lifts the pawl. Lifting the pawl turns the pawl holder, which turns the clamping shaft, releasing the toggle lever and allowing the clamp actuator arm to spring up.

The barring tension/knife cam 13 has a barring tension relief outer surface. When the cam moves, an actuator arm 7 rides on the tension relief surfaces. Those relief surfaces, through a follower, spread thread tension relief plates, reducing thread tension while forming the wide barring stitches. The cam stops with a follower in one of two depressions 92, which deactivates the barring tension relief.

Figure 12:
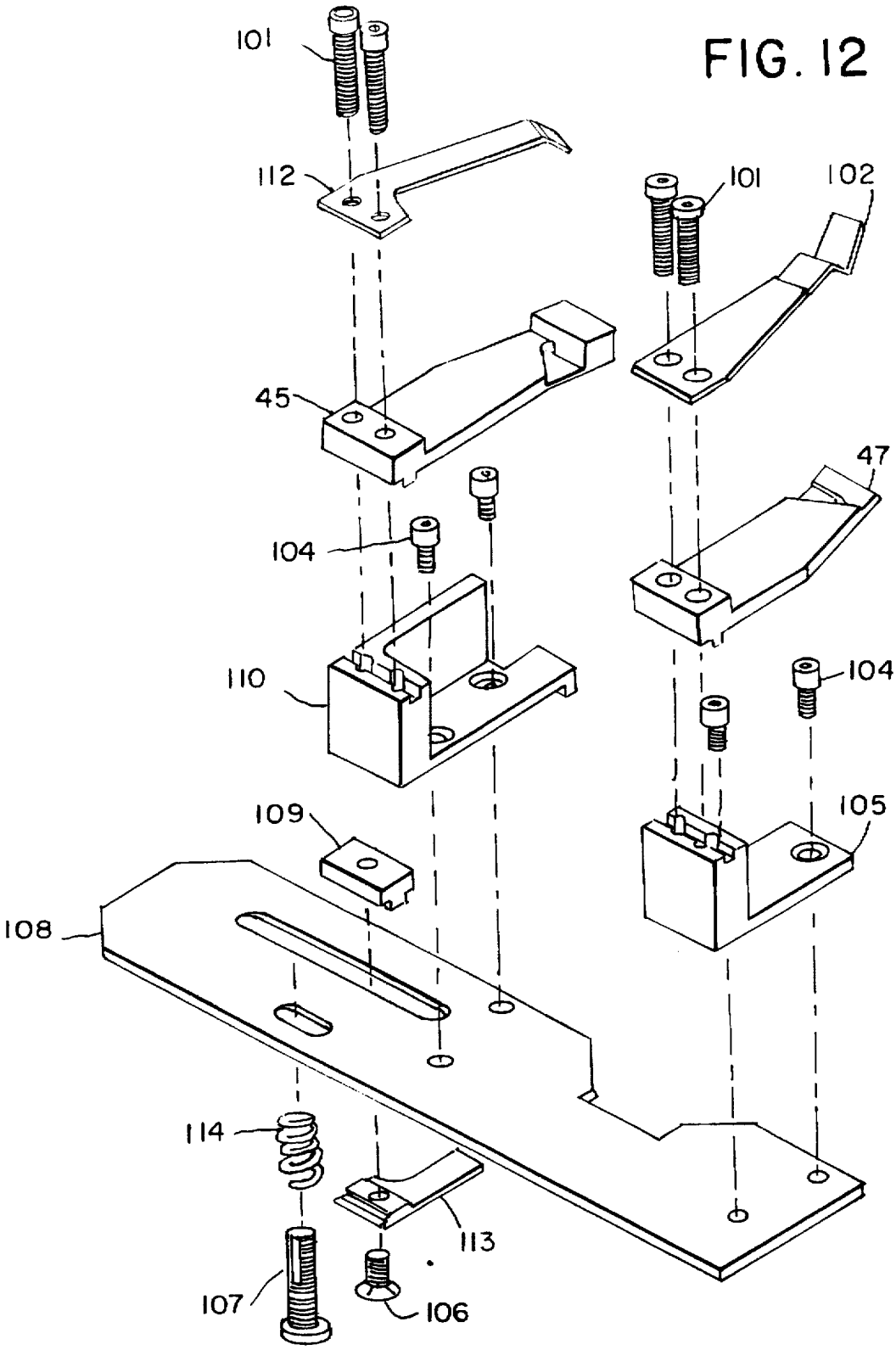
FIG. 12 is an inverted exploded view of the shifter mechanism.

FIG. 12 shows the shifter mechanism. Main shifter plate 108 shifts at the end of each feed. Screws 101 hold the right shifter spring 102 and right shifter arm 47 assembled on a right shifter block 105. Screws 104 hold the right shifter block 105 assembled on the main shifter plate 108.

Screws 101 hold left shifter spring 112 and left shifter arm 45 mounted on left shifter block 110. Screws 104 hold the left shifter block 110 assembled on the shifter plate 108.

An adjustable link nut 109 is positioned in an elongated opening in the shifter plate 108. A screw 106 holds a buttonhole adjusting link 113 on the adjustable link nut 109.

A spring load pin 107 holds spring 114 against the shifter plate 108.

When the clamp plate reaches an end of the buttonhole, the shifter plate 108 is shifted. Loosening and sliding screw 106 slides the nut 109 and adjusting link 113 to control buttonhole length.

Figure 13:
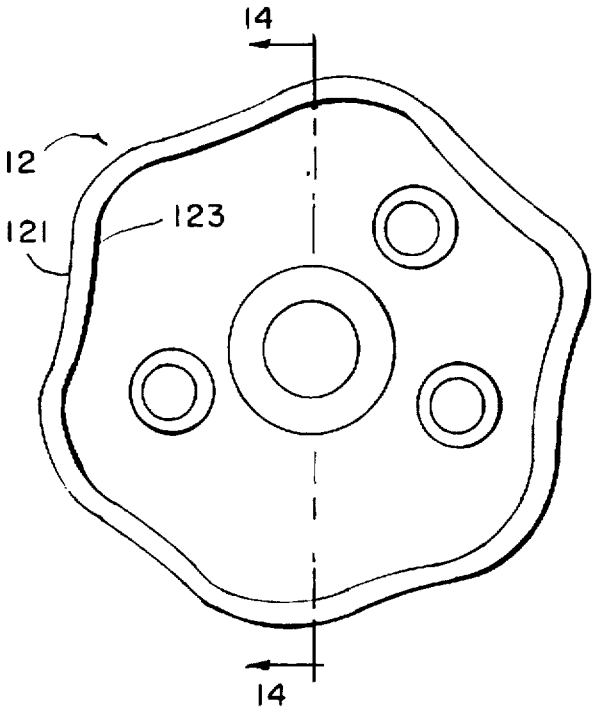
FIG. 13 is an end view of the barring cam showing the inner and outer cam surfaces.
Figure 14:
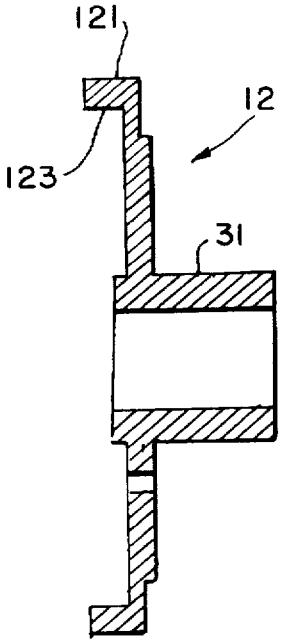
FIG. 14 is a sectional view of the barring cam shown in FIG. 13 taken along lines A—A.

As shown in FIGS. 13 and 14, the barring cam 12 has an outer cam surface 121 and an inner cam surface 123.

The rollers 17 and 18 respectively follow the inner cam surface 123 and the outer cam surface 121.

While the invention has been described with reference to specific embodiments, modifications and variations of the invention may be constructed without departing from the scope of the invention, which is defined in the following claims.

We claim:

1. A buttonhole sewing machine main cam apparatus, comprising a cam assembly having a barring cam, a barring tension/knife cam disk, a feed cam disk, a stop cam disk and a drive disk switch spring connected together, and the cam assembly connected to a drive disk and to a worm gear hub, for driving by a worm gear on a main drive shaft of the buttonhole sewing machine.

2. The apparatus of claim 1, wherein the barring cam, the barring tension/knife cam disk, the feed cam disk and the stop cam disk are connected with screws and nuts, and the drive disk switch spring is connected at one end to the cam disks and is urged away from the cam disks by springs at another end.

3. The apparatus of claim 1, wherein the barring cam, the barring tension/knife cam disk, the feed cam disk and the stop cam disk have central openings extending through the disks, further comprising a shoulder screw extending through the central openings for mounting the barring cam, the barring tension/knife cam disk, the feed cam disk and the stop cam disk on a buttonhole sewing machine body.

4. The apparatus of claim 3, wherein the barring cam has a central bushing extending axially from the barring cam, and wherein the tension/knife cam disk, the feed cam disk, the stop cam disk and the drive disk switch spring have central openings for accommodating the central bushing.

5. The apparatus of claim 4, further comprising a main cam brace rotatably connected to the drive disk and worm gear hub by the shoulder screw.

6. The apparatus of claim 5, further comprising first and second hub shoulder screws connected to the cam brace, a feed reversing lever connected to the first shoulder screw for contacting the feed reversing cam disk, and a knife actuating lever connected to the first hub shoulder screw for contacting the tension/knife cam disk.

7. The apparatus of claim 6, further comprising a barring lever having a bushing connected to the second hub shoulder screw, the barring lever having an extension on which a stud is mounted and a first inner cam follower roller mounted on the stud, a cap screw connected to the extension and an eccentric connected to the cap screw and an outer roller connected to the eccentric, the inner and outer rollers respectively moving along inner and outer cam surfaces of the barring cam.

8. The apparatus of claim 1, further comprising a shifter mechanism slidable with respect to the cam, the shifter mechanism having a main cam shifter plate, a right shifter block connected to the shifter plate, a right shifter arm connected to the right shifter block, and a right shifter spring connected to the right shifter arm for positioning on one side of the cam assembly, and a left shifter block connected to the plate, a left shifter arm connected to the left block, and a left shifter spring connected to the left shifter arm for positioning on a diametrically opposite side of the cam assembly, the shifter plate being movable to engage the right shifter arm or the left shifter arm with the drive disk switch spring.

9. The apparatus of claim 8, wherein the shifter plate further comprises an extension having an elongated opening, an adjustable link nut mounted in the elongated opening, a buttonhole adjusting link connected to the adjustable link nut, and a screw connected to the adjustable link nut and the buttonhole adjusting link for securing the link nut and adjusting link along the elongated opening for determining buttonhole length.

10. A method of coordinating movements in a buttonhole sewing machine, comprising stopping a main cam assembly during forming of bight stitches on sides of a buttonhole, and driving the main cam assembly during formation of long barring stitches at ends of buttonholes, driving a barring lever back and forth with a barring cam of the cam assembly, releasing thread tension with a tension/knife cam disk of the cam assembly and follower during forming of the barring stitches, holding a feed reversing lever in a neutral position with a feed reversing cam of the cam assembly during barring cam movement and moving the feed reversing cam at the end of the barring cam movement.

11. The method of claim 10, further comprising a drive disk switch spring of the cam assembly coming into contact with a shifter arm, pressing the drive disk switch spring down out of engagement with a drive disk and capturing the drive disk switch spring with the shifter arm for stopping the main cam assembly, and further comprising shifting a shifting plate upon a completion of a length of bight stitches along a side of a buttonhole.

12. The method of claim 11, wherein shifting a shifter plate comprises shifting parallel arms on opposite sides of the main cam assembly thereby releasing, from capture by a first shifter arm, the drive disk switch spring while positioning a second, opposite, arm for capturing the drive disk switch spring as the cam rotates the drive disk switch spring to the second arm, capturing the drive disk switch spring with the second arm and stopping the cam assembly while the sewing machine forms stitches along the side of the buttonhole, and then shifting the plate and releasing the drive disk switch spring from the second arm while positioning the first arm for capturing the drive disk switch spring.

13. A method of operating a buttonhole sewing machine, comprising rotating a drive shaft, rotating a worm gear mounted on the drive shaft, rotating a worm gear hub and a drive disk with the worm gear, holding a main multiple disk cam switch spring with a first shift arm while forming bight stitches along one side of a buttonhole, moving the first shift arm away from the multiple disk cam and moving a second shift arm close to the multiple disk cam, releasing the switch spring from the first arm and engaging the switch spring with the drive disk, shifting a feed shaft to a neutral position with a feed cam disk and a feed reversing lever follower, reducing thread tension with a tension cam disk and follower, and moving a clamp plate slidestone back and forth with a barring cam in the cam assembly and a barring lever cam follower, capturing the drive disk switch spring with the second shift arm and restoring thread tension with the tension cam disk and cam follower, shifting feed direction with the feed cam disk and the feed reversing lever follower, stopping the main cam assembly by disengaging the switch spring from the drive disk with the second lever arm, stitching bight stitches along the second side of the buttonhole while the main cam assembly is stopped, shifting the first and second shift arms, moving the second shift arm away from the main cam assembly and moving the first shift arm near the main cam assembly, releasing the drive disk switch spring from the second switch arm, engaging the drive disk switch spring with the drive disk and driving the cam assembly, shifting the feed shaft to neutral with the feed cam disc, reducing thread tension with a tension cam disk, moving a clamp plate slidestone back and forth with the barring cam and barring cam follower, tripping a toggle with a stop cam, enabling a knife operation with a knife cam disk and stopping the drive shaft.

14. The method of claim 13, further comprising driving the cam upon engaging the drive shaft into a detent on the first shifter arm and moving the feed shaft and engaging the feed by moving a feed reversing arm from a neutral position to a first directional position with the feed reversing cam disk.

* * * * *

UNITED STATES PATENT AND TRADEMARK OFFICE

CERTIFICATE OF CORRECTION

PATENT NO. : 5,758,591
DATED : June 2, 1998
INVENTOR(S) : Papajewski, et. al.

It is certified that error appears in the above-identified patent and that said Letters Patent is hereby corrected as shown below:

Column 4, line 25, chnage"A-A" to --14-14--.

Signed and Sealed this

Ninth Day of February, 1999

*Attest:*

*Acting Commissioner of Patents and Trademarks*

*Attesting Officer*